US006739071B2

(12) United States Patent
Andis et al.

(10) Patent No.: US 6,739,071 B2
(45) Date of Patent: May 25, 2004

(54) COMBINED DIFFUSER AND CONCENTRATOR FOR A HAIR DRYER

(75) Inventors: Matthew L. Andis, Racine, WI (US); Thomas C. Maddocks, Racine, WI (US); Albert Wan, Tseun Wan (HK)

(73) Assignee: Andis Company, Racine, WI (US)

( * ) Notice: Subject to any disclaimer, the term of this patent is extended or adjusted under 35 U.S.C. 154(b) by 0 days.

(21) Appl. No.: 10/378,267

(22) Filed: Mar. 3, 2003

(65) Prior Publication Data

US 2003/0177657 A1 Sep. 25, 2003

Related U.S. Application Data

(60) Provisional application No. 60/360,718, filed on Mar. 1, 2002.

(51) Int. Cl.[7] ..... A45D 25/00

(52) U.S. Cl. ..... 34/96; 34/97; 34/98; 392/383; 392/384; 392/385; 392/379; 239/456

(58) Field of Search ..... 34/96, 97, 98; 392/379, 380, 383, 384, 385; 239/455, 602, 600, 418, 456, 451

(56) References Cited

U.S. PATENT DOCUMENTS

| | | | | |
|---|---|---|---|---|
| 761,451 | A | 5/1904 | Cuvelier | |
| 3,782,002 | A | 1/1974 | Morane | |
| 3,860,174 | A | 1/1975 | Cercone | |
| 4,230,279 | A | 10/1980 | Forsberg | |
| 4,287,673 | A | 9/1981 | Wolter | |
| 4,525,623 | A | 6/1985 | Da Silva | |
| 4,538,362 | A | 9/1985 | Andis | |
| 4,602,146 | A | 7/1986 | Barns et al. | |
| 4,848,007 | A | 7/1989 | Montagnino | |
| 4,896,021 | A | 1/1990 | Poweleit et al. | |
| 4,977,306 | A | 12/1990 | Kosaka et al. | |
| 5,060,398 | A | 10/1991 | Wolens | |
| 5,120,274 | A | 6/1992 | Zeller | |
| 5,157,757 | A | 10/1992 | McDougall | |
| 5,467,540 | A | 11/1995 | Bastien | |
| 5,553,632 | A | 9/1996 | Burkhardt | |
| 5,598,640 | A | 2/1997 | Schepisi | |
| 5,649,370 | A | 7/1997 | Russo | |
| 5,661,910 | A | 9/1997 | Schepisi | |
| 5,725,159 | A | 3/1998 | Dorber et al. | |
| D396,127 | S | 7/1998 | Schepisi | |
| 5,842,286 | A | 12/1998 | Cantor | |
| 6,199,295 | B1 * | 3/2001 | Smal et al. | 34/98 |

* cited by examiner

*Primary Examiner*—Henry Bennett
*Assistant Examiner*—Camtu Nguyen
(74) *Attorney, Agent, or Firm*—Michael Best & Friedrich LLP

(57) ABSTRACT

A hand-held hair dryer including a handle, a body connected to the handle portion, a barrel connected to the body portion and having an inner member defining a first air passageway, an outer member slidably coupled to the inner member and defining a second air passageway that is substantially parallel to the first air passageway, a shutter coupled to the inner member and movable in response to sliding of the outer member with respect to the inner member to selectively direct air through the first air passageway and the second air passageway.

20 Claims, 4 Drawing Sheets

COMBINED DIFFUSER AND CONCENTRATOR FOR A HAIR DRYER

This application claims the benefit of Provisional Application No. 60/360,718 filed Mar. 1, 2002.

FIELD OF THE INVENTION

The invention relates to hand-held hair dryers, and more particularly to hand-held hair dryers capable of producing both diffuse and concentrated air flow.

BACKGROUND OF THE INVENTION

Hand-held hair dryers are typically designed to emit a concentrated flow of heated air from the dryer nozzle or barrel to quickly dry the user's hair. It is also known to modify the dryer to create a more diffuse flow of air, allowing the user to dry hair more gently. This diffuse flow is often beneficial during the styling process.

One way of converting the concentrated air flow to a diffuse air flow is to use a simple diffuser attachment. U.S. Pat. No. 4,848,007 discloses a diffuser attachment that can be removably attached to the barrel of a hair dryer to convert the concentrated blast of air to a more gentle, diffuse flow. The conversion between concentrated air flow and diffuse air flow depends only on whether the attachment is connected to the barrel of the hair dryer. This type of diffuser attachment is well-known in the industry and is highly effective for creating a larger diffuse zone of axial flow from the end of an otherwise confined and concentrating barrel.

Other prior art hair dryers employ alternative designs that are capable of varying the air flow. Many of these prior art hair dryers include shutter mechanisms positioned in the barrel of the hair dryer. The shutter mechanisms are actuated by the user to vary the flow of air being emitted from the hair dryer.

For example, U.S. Pat. Nos. 4,602,146 and 5,661,910 disclose hair dryers having shutter mechanisms that operate to substantially close the end of the barrel and redirect the air flow radially through holes or slots in the radial periphery of the barrel. U.S. Pat. Nos. 4,525,623 and 4,977,306 disclose hair dryers having shutter mechanisms that vary the flow rate of air exiting the barrel by effectively changing the size of the exit opening.

U.S. Pat. No. 5,157,757 discloses another system for varying the flow of air exiting a hair dryer. In this system, a flexible metal foil is used as a baffle for closing the end of the barrel and thereby causing the air to be redirected radially through slots in the radial periphery of the barrel

SUMMARY OF THE INVENTION

The present invention provides a hair dryer including a combined diffuser and concentrator assembly. In one embodiment, the hair dryer includes a handle and a body connected to the handle, a barrel connected to the body, the barrel having an inner member defining a first air passageway. The barrel also includes an outer member slidably mounted on the inner member, the outer member defining a second air passageway. The hair dryer also includes a shutter coupled to the inner member and movable in response to sliding of the outer member with respect to the inner member to selectively direct air through at least one of the first air passageway and the second air passageway.

In another embodiment, the invention provides an attachment for a hand-held hair dryer. The attachment includes a tubular inner member securable to the hair dryer and defining a central flow path having a central flow axis, the inner member including a plurality of circumferentially distributed apertures. The attachment also includes an outer member slidably coupled to the inner member and having an axially-extending, substantially annular flange portion, the outer member configured to substantially annularly surround the inner member and to define an flow path having a flow direction that is substantially parallel to the central flow axis. The attachment also includes a shutter member pivotally coupled to the inner member and pivotable in response to sliding of the outer member with respect to the inner member. The sliding of the outer member with respect to the inner member moves the attachment between a first position wherein the flange portion substantially overlies the apertures and the shutter member affords air flow through the central flow path, and a second position wherein the apertures afford fluid communication between the central flow path and the annular flow path and the shutter member at least partially restricts air flow through the central flow path.

In another embodiment, the invention provides an attachment for a hand-held hair dryer. The attachment includes an inner member releasably securable to the hair dryer, the inner member defining a central flow channel having a central flow axis and opening axially away from the hair dryer. The attachment also includes an outer member slidably coupled to the inner member and providing an annular flow channel at least partially surrounding the central flow channel and opening axially away from the hair dryer. The attachment also includes a shutter member pivotally coupled to the inner member for pivotal movement about a pivot axis that is substantially perpendicular to the central flow axis wherein the shutter member pivots in response to relative sliding movement of the inner member and the outer member to at least partially regulate air flow through the central flow channel and the annular flow channel.

Other features and advantages of the invention will become apparent to those skilled in the art upon review of the following detailed description, claims, and drawings.

Figure 1:
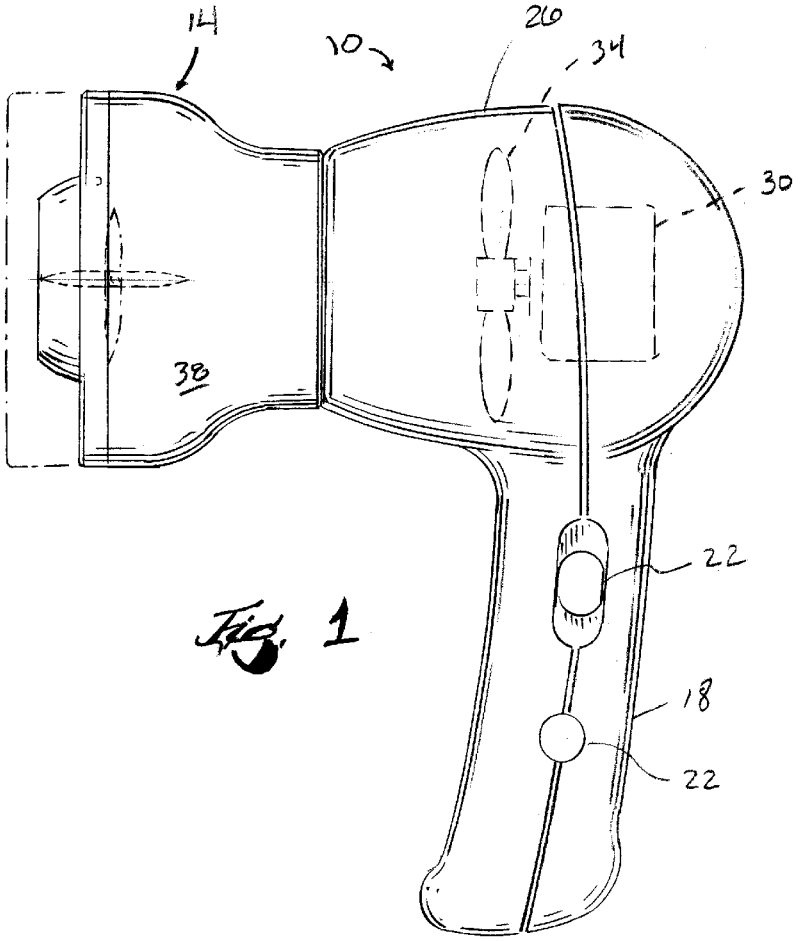
FIG. 1 is a side view of a hair dryer embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order.

DETAILED DESCRIPTION OF THE PREFERRED EMBODIMENT

The drawings illustrate a hand-held, electrically powered hair dryer 10 embodying the invention. In particular, and with reference to FIG. 1, the hair dryer 10 includes a handle 18 providing operating switches 22, and a body 26 which is connected to the handle portion 18 and which defines (FIG. 6) an outlet 28 centered on an exhaust axis 44. Referring to FIG. 1, body 26 houses an electric motor 30 that is operably coupled to a fan 34. The motor 30 is electrically connected with the operating switches 22 to afford selective operation of the fan 34. The body 26 also houses (FIG. 4) a heating element 42 located adjacent the outlet. The heating element 42 is electrically powered and is operably connected to the switches 22. Operation of the fan 34 draws air into the body portion 26 and forces it over the heating element 42 and through the outlet 28 in a direction that is substantially parallel to the exhaust axis 44.

The hair dryer 10 also includes a combined diffuser/concentrator attachment assembly 14 that can be selectively, removably fixed to the body 26 adjacent the outlet 28. The attachment assembly 14 provides a barrel or nozzle assembly 38 that can be selectively moved relative to the body 26 between a first, retracted position (shown in solid lines in FIG. 1) and a second, extended position (shown in phantom in FIG. 1). As detailed below, the attachment assembly 14 includes (FIG. 2) telescopically arranged inner and outer barrel members 50, 54 which cooperate to provide complementary first and second air flow paths communicating with the outlet 28 of the body 26. Movement of the barrel assembly 38 between the retracted and extended positions alternatively opens and closes the flow paths. This selective positioning of the barrel assembly 38 affords selective operation of the hair dryer 10 to provide a diffused air flow and, alternatively, a concentrated air flow.

Figure 2:
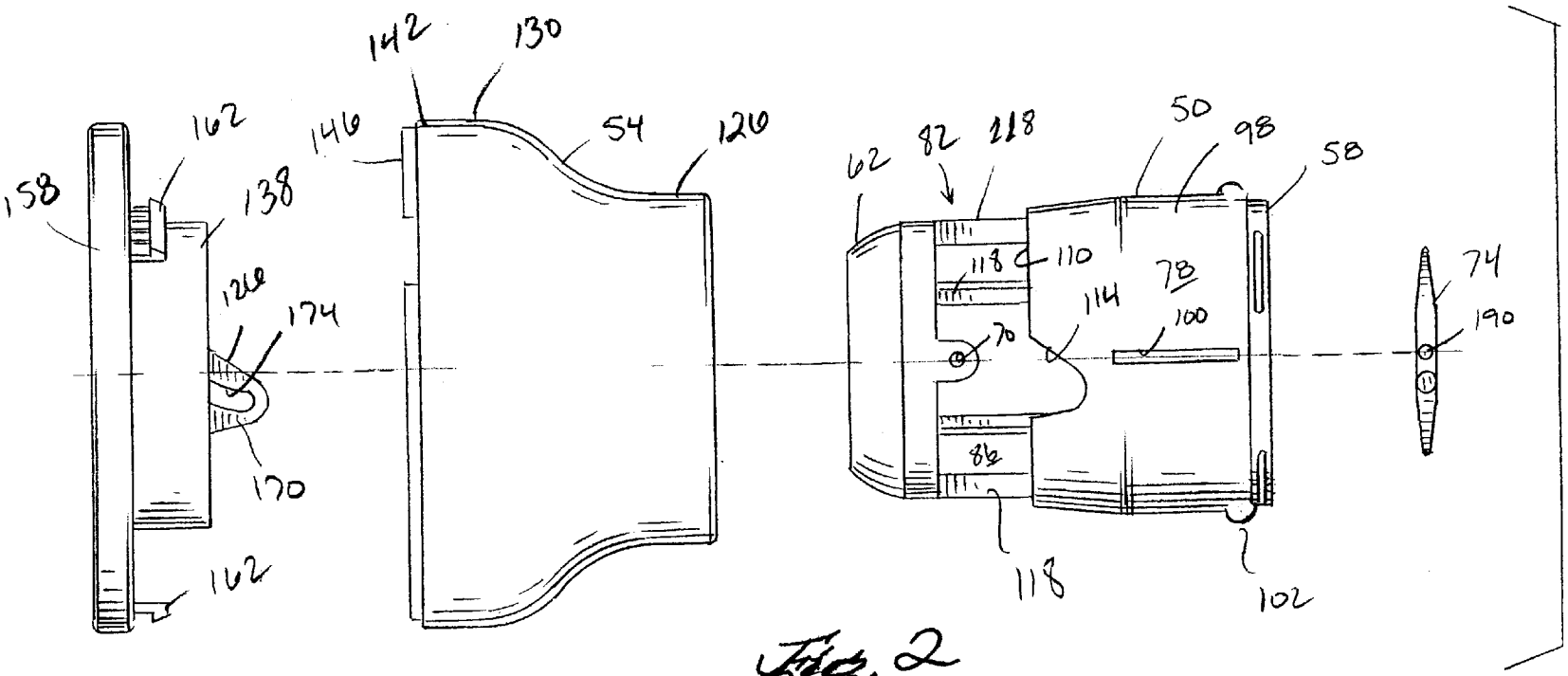
FIG. 2 is an enlarged, exploded side view of the dryer shown in FIG. 1.

More particularly, referring now to FIG. 2, the generally tubular inner barrel 50 has opposite ends: an inlet end 58 which can be fixed to the body 26 so as to align and communicate with the outlet 28, and a nozzle end 62 that preferably defines a constricted opening 66. Preferably, the inlet end 58 has structure which cooperates with the body 26 to afford selective attachment and removal of the assembly 14 to the body 26. In the preferred embodiment, the inlet end provides a plurality of circumferentially extending ribs 90 that are configured to secure the attachment assembly 14 to the body 26 of the hair dryer 10, however other methods of securing the attachment assembly 14 to the hair dryer 10 are possible and within the scope of the present invention.

The nozzle end 62 of the inner barrel 50 has a diameter smaller than the inlet end 58 of the inner barrel 50, and has therein a pair of diametrically opposed bores 70 (one shown in FIG. 2) which serve as mounting bosses for a shutter 74 which is mounted on the inner barrel 50 for pivotal movement between open and closed positions, and which is engaged with the outer barrel 54 for movement between the opened and closed positions as the assembly 14 is moved between retracted and extended positions.

The inner barrel 50 has two portions extending between the inlet and nozzle ends 58, 62: an imperforate section 78 adjacent the inlet end 58 and a perforated section 82 adjacent the nozzle end 62 having plurality of radial openings 86. The imperforate section 78 has a generally uniform interior surface 90 which extends between the inlet end 58 and the openings 86 in the perforated section 82, and which provides a flow path portion 94 communicating with the outlet 28 of the body 26. The imperforate section 78 has an exterior surface 98 which provides a radially extending collar 102 located adjacent the inlet end 58. The collar 102 is engagable with the outer barrel 54 when the attachment assembly 14 is moved into the retracted position to prevent movement of the outer barrel 54 beyond the inlet end 58 of the inner barrel 50. The exterior surface 98 of the imperforate section 78 also has therein a series of axially extending grooves 100. The grooves 100 are spaced apart about the circumference of the inner barrel 50 and engage the outer barrel 54 in a manner detailed below to guide axial movement of the outer barrel 54 relative to the inner barrel 50 between the extended and retracted positions.

For reasons detailed below, the end 110 of the imperforate section 78 of the inner barrel 50 also includes a recess 114 extending toward the inlet end 58 of the inner barrel 50. The recess 114 accommodates and receives a portion of the outer barrel 54 when the outer barrel 54 is moved into the retracted position.

The openings 86 in the perforated section 82 of the inner barrel 50 are defined by a series of axially extending ribs 118. The ribs 118 are spaced-apart circumferentially about the axis of the inner barrel 50, and extend from the interior surface 90 of the inner barrel 50 so that the circumference of the perforated section 82 approximates the circumference of the nozzle end 62 of the inner barrel 50, i.e., is less than the circumference of the inlet end 58 of the inner barrel 50. The openings 86 in the perforated section 82 define air flow passage portions 122 communicating with the flow path portion 94 defined by the imperforate section 78, afford passage of air flow therethrough in a direction diverging from the axis 44.

Figure 6:
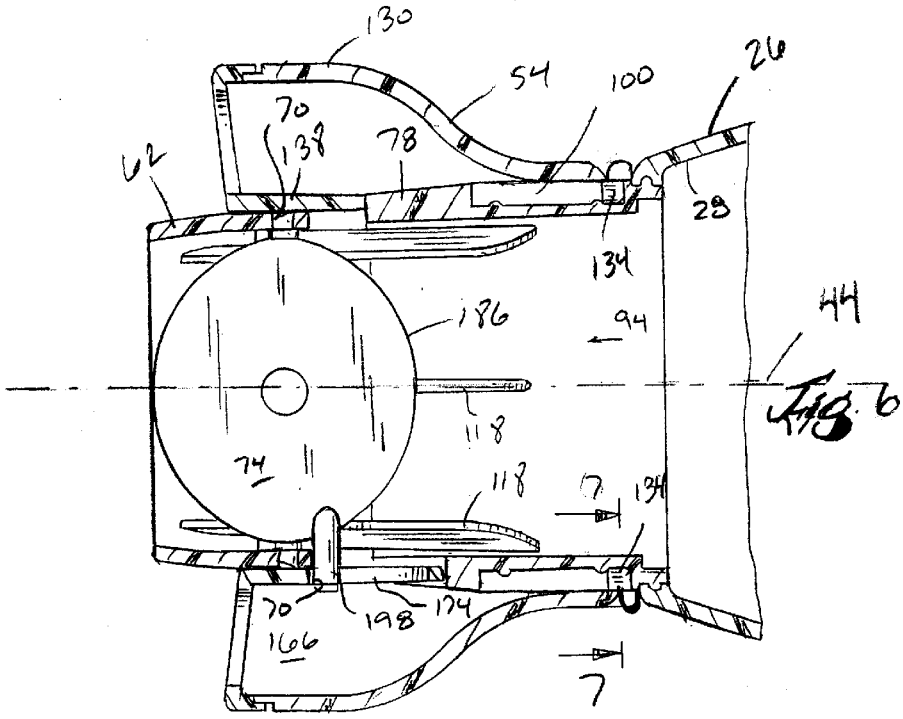
FIG. 6 is a section view taken along line 6—6 of FIG. 4.
Figure 3:
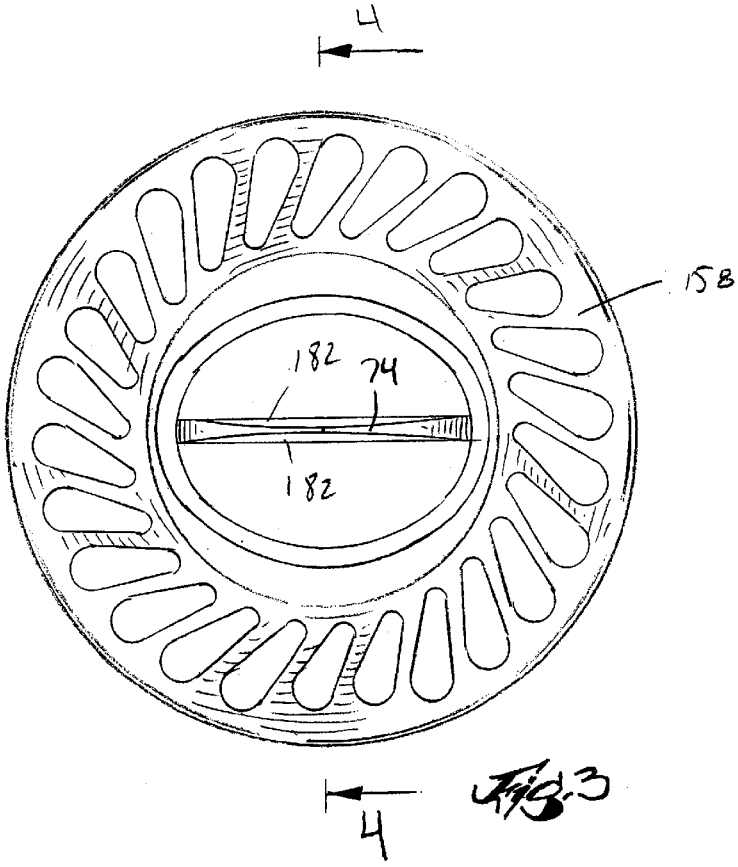
FIG. 3 is an end view of the dryer shown in FIG. 1.
Figure 7:
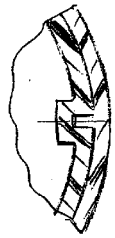
FIG. 7 is a section view taken along line 7—7 of FIG. 6.
Figure 4:
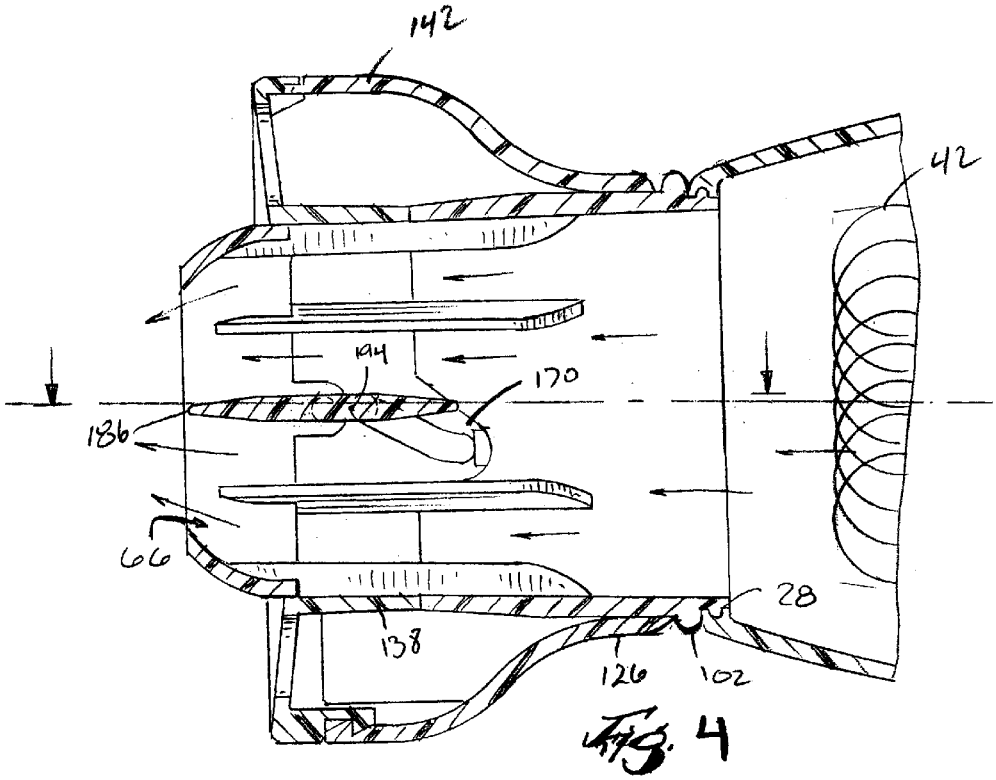
FIG. 4 is a section view taken along line 4—4 of FIG. 3 showing the attachment assembly in a first position.

The outer barrel 54 also has opposed open ends: a tubular end 126 and a diffuser end 130. The tubular end 126 of the outer barrel 54 is generally cylindrical, is imperforate, and is sized to telescopically receive the inner barrel 50. The outer barrel 54 is slidably mounted on the inner barrel 50 in a manner affording relative telescopic movement between the retracted and extended positions. In this regard, the tubular end 126 of the outer barrel 54 includes (FIG. 6) a plurality of radially inwardly extending projections or tabs 134 that are slidably received by the grooves 100 in the exterior surface of the imperforate section 78 of the inner barrel 50. The cooperating tabs 134 and grooves 100 afford and guide the axial movement of the outer barrel 54 relative to the inner barrel 50 between the extended position wherein the tabs 134 engage the ends of the grooves 100 adjacent the perforated section 82 of the inner barrel 50 and the retracted position wherein the tabs 134 are located adjacent the inlet end 58 of the inner barrel 50 and the tubular end 126 of the outer barrel 54 engages the collar 102 on the inner barrel 50. When the outer barrel 54 is moved into the retracted position (as shown in FIG. 4 and FIG. 6), the tubular end 126 of the outer barrel 54 telescopically receives and overlies the imperforate section 78 of the inner barrel 50. Notably, the engagement of the tabs 134 and grooves 100 also control the rotational arrangement of the inner and outer barrels 50, 54. In the illustrated embodiment, the rotational relationship of the inner and outer barrels 50, 54 is fixed.

Figure 5:
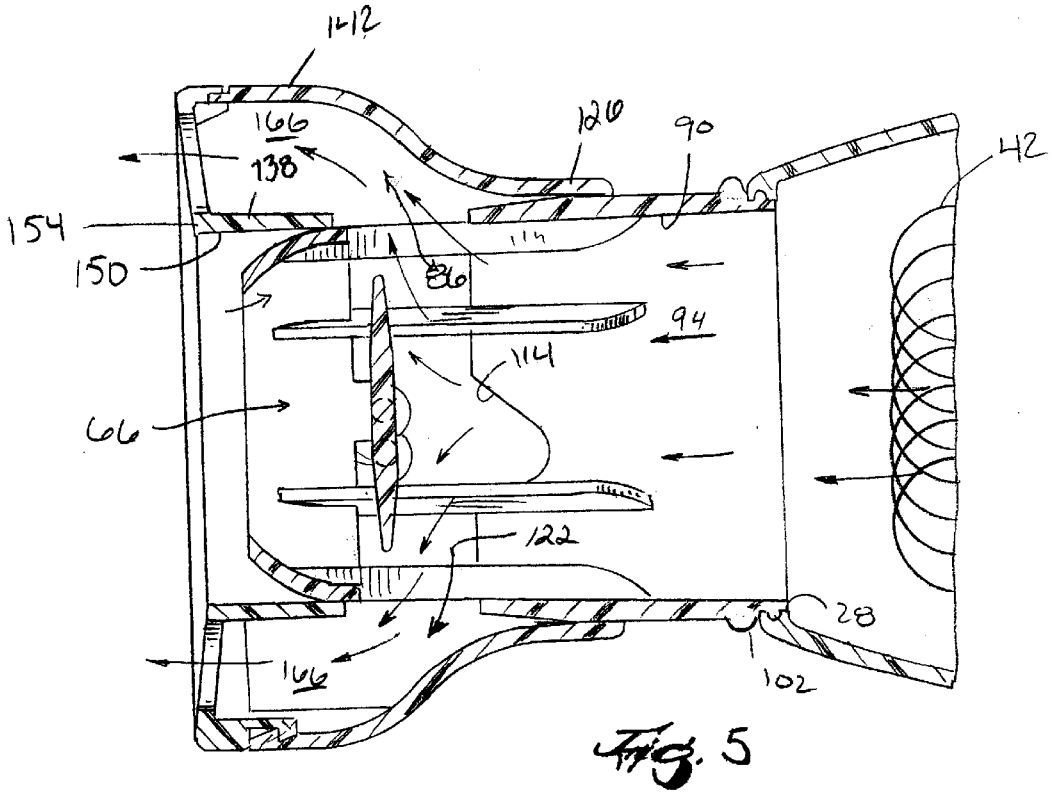
FIG. 5 is a section view similar to FIG. 4 showing the attachment assembly in a second position.

The diffuser end 130 of the outer barrel 54 includes (FIGS. 4 and 5) concentrically arranged inner and outer portions 138, 142. The outer portion or shroud 142 extends continuously from the tubular portion 126 both axially and radially to a distal end 146.

The inner portion 138 is generally imperforate and has a cylindrical configuration. The inner portion 138 of the diffuser 130 provides (FIG. 5) an interior surface sized 150 to approximate that of the imperforate section 78 of the inner barrel 50 and to telescopically receive the nozzle end 62 and imperforate section 78 of the inner barrel 50. The axial extent of the inner portion 138 of the diffuser 130 is such that the distal end 154 of the inner portion 138 is generally coplanar with the distal end 146 of the shroud 142. In this regard, the distal end 154 of the inner portion 138 and the distal end 146 of the shroud 142 are connected by a perforated diffuser face plate 158. In the illustrated embodiment, the outer barrel 54 is an assembly of the shroud 142, the inner portion 138 and the face plate 158. The face plate 158 includes a plurality (e.g. three as illustrated) of tabs 162 that resiliently snap into engagement with recesses or other retaining structure on the distal end 146 of the shroud 142 to secure the face plate 158 and inner portion 138 to the shroud 142, thereby forming the outer barrel 54.

The length of the inner portion 138 of the diffuser 130 is such that the inner portion 138 engages the imperforate section 78 of the inner barrel 50 when the outer barrel 54 is moved into the retracted position, and is spaced apart from the imperforate section 78 of the inner barrel 50 when the outer barrel 54 is moved into the extended position. Also the length of the inner portion 138 is such that when the outer barrel 54 is in the retracted position, the nozzle end 62 of the inner barrel 50 extends axially past the face plate 158 and is exposed. The length of the inner portion 138 is also such that the end of the inner portion 138 facing the body 26 of the hair dryer is radially spaced from the shroud 142. This spacing thus provides an annular passage portion 166 between the inner portion 138 of the diffuser 130 and the shroud 142. The diffuser passage 166 extends from the end of the inner portion 138 facing the body 26 to the face plate 158.

Further in this regard, the inner portion 138 of the diffuser 130 includes (FIGS. 2 and 4) an axially extending flange 170 having therein a guide slot 174 that has an extent diverging from the central axis 44. The slot 130 engages a portion of the shutter 74 in a manner described below to pivot the shutter 74 between the open and closed positions. The flange 170 has an edge profile 126 that substantially matches the profile of the recess 114 in the imperforate section 78 of the inner barrel 50. The flange 170 is received by the recess when the outer barrel 54 is moved into the retracted position.

This arrangement of the inner portion 138 relative to the inner barrel 50 serves to provide, in part, alternative flow paths. More particularly, when the outer barrel 54 is (FIG. 4) moved into the retracted position, the imperforate section 78 of the inner barrel 50 and the imperforate inner portion 138 of the diffuser 130 are in end-to-end engagement, and cooperate to define a continuous first flow path between the outlet 28 of the body 26 to the nozzle. When the outer barrel 54 is (FIG. 5) moved away from the body 26 toward the extended position, the inner portion 138 of the diffuser 130 moves into a position surrounding the nozzle and away from the openings 86 in the perforated section 82 of the inner barrel 50. When the outer barrel 54 is so extended, the passage in the diffuser 130 communicates with the openings 86 in the inner barrel 50 to define a second flow path extending between the face plate 158 and the outlet. As explained below, extension of the barrel assembly also pivots the shutter 74 closed so that as the second flow path is opened, the first flow path is closed.

In particular, the shutter 74 is located within the inner barrel 50 adjacent the nozzle end 62. The shutter 74 is disc shaped, has opposed planar faces 182 and a periphery 186 approximating the inner surface of the nozzle 62. The shutter 74 includes a pair of diametrically opposed and radially extending pins 190 that define a pivot axis 194 and that are received by the opposed bores 70 in the nozzle end 62 of the inner barrel 50. The shutter 74 is thus pivotally secured to the inner barrel 50. The shutter 74 also includes a guide pin 198 that extends radially and parallel the pins 190 and is spaced from the pivot axis 194. The guide pin 198 is received by the slot 174 in the flange 170 on the inner portion 138 of the diffuser 130. Because of the angled orientation of the slot 174 and the offset of the guide pin 198 from the pivot axis 194, the guide pin 198 is moved radially relative to the axis 44 when the inner and outer barrels 50, 54 are moved between the retracted and extended positions. This movement of the guide pin 198 pivots the shutter 74 between a streamwise position (shown in FIG. 4), wherein the faces of the shutter 74 are oriented substantially parallel to the flow axis 44, and a cross-streamwise position (shown in FIG. 5), wherein the faces 182 of the shutter 74 are oriented substantially perpendicular to the flow axis 44.

Thus, when the assembly 14 is in the retracted position, the imperforate section 78 of the inner barrel 50 and the inner portion 138 of the diffuser 130 are engaged to form the first flow path between the outlet 28 and the nozzle, which is located centrally of the diffuse face plate 158. Also, when the assembly 14 is in the retracted position, the shutter 74 is in its open position. Notably, when retracted, the inner portion 138 of the diffuser 130 overlies the openings 86 in the inner barrel 50, thus disrupting the second air flow path. In this position, i.e., when the assembly 14 is in the retracted position, operation of the fan and the assembly 14 provides a concentrated flow of air from the drier.

When the assembly 14 is moved to the extended position, the inner portion 138 of the diffuser 130 moves away from and exposes the openings 86 in the inner barrel 50, thus completing the second flow path from the outlet 28 to the passage of the diffuser 130. Also, when the assembly is moved to the extended position, the shutter 74 closes to disrupt the first air flow. In this position, i.e., when the assembly is in the extended position, operation of the fan and the assembly 14 provides a diffused flow of air from the drier, namely from the outlet 28, along the imperforate portion of the inner barrel 50, radially outwardly through the openings 86 in the perforated portion of the inner barrel 50, radially and axially outwardly along the diffuser passage 166, and through the face plate 158.

Figure 8:
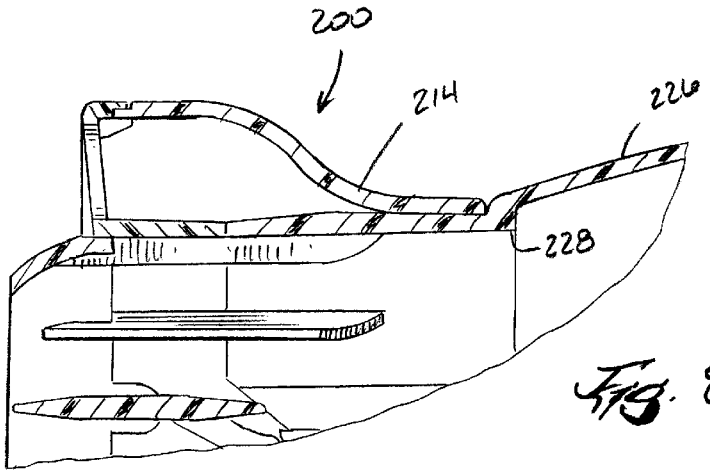
FIG. 8 is a view similar to FIG. 4 and illustrates a hair dryer that is an alternative embodiment of the invention.

FIG. 8 illustrates a hair dryer 200 that is an alternative embodiment of the invention. Hair dryer 200 is identical to the dryer 10 also includes a body portion 226 and an exhaust opening 228. The hair dryer 200 also includes a combined diffuser/concentrator attachment assembly 214 that can is fixed to the body 226 adjacent the outlet 228. The assembly 214 is identical to assembly 14 except that the assembly 214 is not easily removed from the body 226, i.e., the assembly provides a nozzle assembly that can be selectively moved relative to the body 226 between a first, retracted position and a second, extended position to provide complementary first and second air flow paths communicating with the outlet 228 of the body 226. Movement of the assembly 214 between the retracted and extended positions alternatively opens and closes the complementary flow paths. This selective positioning of the assembly 214 affords selective operation of the hair dryer 200 to provide a diffused air flow and, alternatively, a concentrated air flow.

While the illustrated embodiments include a butterfly valve type shutter 74, it should be appreciated that other types, styles, and configurations of flow disrupting or directing elements may be employed to selectively direct the flow of air between the first flow path and the second flow path. Similarly, the opening and closing of the openings 66 may be accomplished in a variety of ways.

Various features of the invention are set forth in the following claims.

What is claimed is:

1. A hand-held hair dryer comprising:

a handle portion;

a body portion connected to the handle portion;

a barrel portion connected to the body portion, the barrel portion having an inner member defining a first air passageway;

an outer member slidably coupled to the inner member, the outer member defining a second air passageway that is substantially parallel to the first air passageway; and a shutter member coupled to the inner member and movable in response to sliding of the outer member with respect to the inner member to selectively direct air through at least one of the first air passageway and the second air passageway.

2. The hand-held hair dryer of claim 1, wherein the inner member, the outer member, and the shutter member form an integral attachment that can be removed from the hair dryer.

3. The hand-held hair dryer of claim 1, wherein the outer member is slidable with respect to the inner member from a first position, wherein air flows through only the first passageway, thereby providing a concentrated air flow, to a second position, wherein air flows through the second air passageway, thereby providing a diffuse air flow.

4. The hand-held hair dryer of claim 3, wherein the shutter member is disposed substantially parallel to the direction of airflow through the first air passageway when the outer member is in the first position, and the shutter member is disposed at an angle to the direction of airflow through the first air passageway when the outer member is in the second position.

5. The hand-held hair dryer of claim 1, wherein the inner member includes a plurality of apertures upstream of the shutter member, and wherein in response to sliding of the outer member with respect to the inner member, the plurality of apertures selectively provide and prohibit fluid communication between the first passageway and the second passageway.

6. The hand-held hair dryer of claim 1, wherein the shutter member is pivotable about a pivot axis and includes a guide protrusion spaced from and extending substantially parallel to the pivot axis, and wherein the outer member includes a guide slot adapted to receive the guide protrusion.

7. The hand-held hair dryer of claim 6, wherein the guide slot and guide protrusion cooperate with each other to pivot the shutter member about the pivot axis in response to sliding of the outer member with respect to the inner member.

8. The hand-held hair dryer of claim 1, wherein the first air passageway defines a flow axis and wherein the outer member includes a plurality of circumferentially spaced apart apertures opening axially away from the body portion.

9. A hand-held hair dryer comprising:

a body portion;

a handle portion;

a substantially tubular inner member securable to the body portion and defining a central flow path having a central flow axis, the inner member including a plurality of circumferentially distributed apertures;

an outer member slidably coupled to the inner member and having an axially-extending, substantially annular flange portion, the outer member configured to substantially annularly surround the inner member and to define an annular flow path having a flow direction that is substantially parallel to the central flow axis; and a shutter member pivotally coupled to the inner member and pivotable in response to sliding of the outer member with respect to the inner member;

wherein sliding of the outer member with respect to the inner member adjusts the hair dryer between a first configuration wherein the flange portion substantially overlies the apertures and the shutter member affords air flow through the central flow path, and a second configuration wherein the apertures afford fluid communication between the central flow path and the annular flow path and the shutter member at least partially restricts air flow through the central flow path.

10. The hand-held hair dryer of claim 9, wherein when the hair dryer is in the first configuration, air flows through substantially only the central flow path, and wherein when the hair dryer is in the second configuration, air flows through the annular flow path.

11. The hand-held hair dryer of claim 9, wherein the shutter member is disposed substantially parallel to the central flow axis when the hair dryer is in the first configuration, and wherein the shutter member is disposed substantially perpendicular to the central flow axis when the hair dryer is in the second configuration.

12. The hand-held hair dryer of claim 9, wherein the outer member is in a retracted position with respect to the inner member when the hair dryer is in the first configuration, and wherein the outer member is in an extended position with respect to the inner member when the hair dryer is in the second configuration.

13. The hand-held hair dryer of claim 9, wherein the apertures are upstream of the shutter member.

14. The hand-held hair dryer of claim 9, wherein the shutter member pivots about a pivot axis and includes a guide protrusion spaced from and extending substantially parallel to the pivot axis, and wherein the outer member includes a guide slot adapted to receive the guide protrusion.

15. The hand-held hair dryer of claim 14, wherein the guide slot and guide protrusion cooperate with each other to pivot the shutter member about the pivot axis in response to sliding of the outer member with respect to the inner member.

16. The hand-held hair dryer of claim 9, wherein the attachment provides a concentrated air flow when the attachment is in the first configuration, and wherein the attachment provides a diffuse air flow when the attachment is in the second configuration.

17. A hand-held hair dryer comprising:

a body portion;

a handle portion;

an inner member releasably secured to the body portion, the inner member defining a central flow channel having a central flow axis and opening axially away from the hair dryer;

an outer member slidably coupled to the inner member and providing an annular flow channel at least partially surrounding the central flow channel and opening axially away from the hair dryer; and a shutter member pivotally coupled to the inner member for pivotal movement about a pivot axis that is substantially perpendicular to the central flow axis wherein the shutter member pivots in response to relative sliding movement of the inner member and the outer member to at least partially regulate air flow through the central flow channel and the annular flow channel.

18. The hand-held hair dryer of claim 17, wherein the outer member is slidable with respect to the inner member from a first position, wherein air flows through only the central flow channel, thereby providing a concentrated air flow, to a second position, wherein air flows through the annular flow channel, thereby providing a diffuse air flow.

19. The hand-held hair dryer of claim 17, wherein the inner member includes a plurality of apertures upstream of the shutter member, wherein the plurality of apertures are selectively opened and closed in response to sliding of the outer member with respect to the inner member to selectively provide fluid communication between the central flow channel and the annular flow channel.

20. The hand-held hair dryer of claim 17, wherein the shutter member pivots about a pivot axis and includes a guide protrusion spaced from and extending substantially parallel to the pivot axis, wherein the outer member includes a guide slot adapted to receive the guide protrusion, and wherein the guide slot and guide protrusion cooperate with each other to pivot the shutter member about the pivot axis in response to sliding of the outer member with respect to the inner member.

* * * * *